US005152727A

United States Patent [19]

Moore et al.

[11] Patent Number: 5,152,727

[45] Date of Patent: Oct. 6, 1992

[54] WATER HURDLE APPARATUS

[76] Inventors: James L. Moore; Tamara J. Moore, both of Rt. 6, Box 1058-B, Astoria, Oreg. 97103

[21] Appl. No.: 808,214

[22] Filed: Dec. 16, 1991

[51] Int. Cl.[5] ..... A63B 5/22

[52] U.S. Cl. ..... 482/15; 239/289

[58] Field of Search ..... 482/15, 16, 17; 446/475; 239/289, 279; 273/26 R

[56] References Cited

U.S. PATENT DOCUMENTS

| | | | |
|---|---|---|---|
| 1,710,888 | 4/1924 | Munz | 239/289 |
| 2,940,446 | 6/1960 | Speight | 239/289 |
| 3,170,171 | 2/1965 | Maghew | 472/128 |
| 3,866,916 | 2/1975 | Clarke | 472/128 |
| 3,933,111 | 1/1976 | Lemelson | 239/289 |
| 4,892,302 | 1/1990 | Daigle | 482/15 |

*Primary Examiner*—Richard J. Apley
*Assistant Examiner*—Jerome Donnelly
*Attorney, Agent, or Firm*—Leon Gilden

[57] ABSTRACT

Water hurdles are provided to include a plurality of "L" shaped supports mounted to underlying plates, wherein the supports are arranged to direct fluid nozzles in a coincident relationship relative to one another to provide for a hurdle structure.

5 Claims, 4 Drawing Sheets

WATER HURDLE APPARATUS

BACKGROUND OF THE INVENTION

1. Field of the Invention

The field of invention relates to hurdle apparatus, and more particularly pertains to a new and improved water hurdle apparatus wherein the same is arranged to utilize water hurdles in lieu of traditional mechanical rigid hurdle bars.

2. Description of the Prior Art

Mechanical hurdles utilized in the prior art have typically been rigid and have been oriented to "tip over" upon impact by a runner. Such runners are in a vulnerable physical position during a jumping event and to minimize such danger, the instant invention is provided to utilize a fluid stream in lieu of a mechanical hurdle as a jumping obstacle. Various prior art structure as a source of entertainment and amusement is found in U.S. Pat. No. 4,822,053 to Flaherty as a game barrier wherein an arch is arranged for separting areas where a water hose connection may be provided to direct a spray below the arch.

U.S. Pat. No. 4,946,164 to Fuller, et al. sets forth a water stream to support a ball for impact by a player with a bat.

As such, it may be appreciated that there continues to be a need for a new and improved water hurdle apparatus as set forth by the instant invention which addresses both the problems of ease of use as well as effectiveness in construction in providing a water hurdle organization for use in a track and field event and in this respect, the present invention substantially fulfills this need.

SUMMARY OF THE INVENTION

In view of the foregoing disadvantages inherent in the known types of water apparatus now present in the prior art, the present invention provides a water hurdle apparatus wherein the same is arranged to provide for a fluid hurdle in lieu of rigid mechanical hurdles utilized in track and field. As such, the general purpose of the present invention, which will be described subsequently in greater detail, is to provide a new and improved water hurdle apparatus which has all the advantages of the prior art hurdle apparatus and none of the disadvantages.

To attain this, the present invention provides a water hurdle to include a plurality of "L" shaped supports mounted to underlying plates, wherein the supports are arranged to direct fluid nozzles in a coincident relationship relative to one another to provide for a hurdle stucture.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water hurdle apparatus which has all the advantages of the prior art hurdle apparatus and none of the disadvantages.

It is another object of the present invention to provide a new and improved water hurdle apparatus which may be easily and efficiently manufactured and marketed.

It is a further object of the present invention to provide a new and improved water hurdle apparatus which is of a durable and reliable construction.

An even further object of the present invention is to provide a new and improved water hurdle apparatus which is susceptible of a low cost of manufacture with regard to both materials and labor, and which accordingly is then susceptible of low prices of sale to the consuming public, thereby making such water hurdle apparatus economically available to the buying public.

Still yet another object of the present invention is to provide a new and improved water hurdle apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
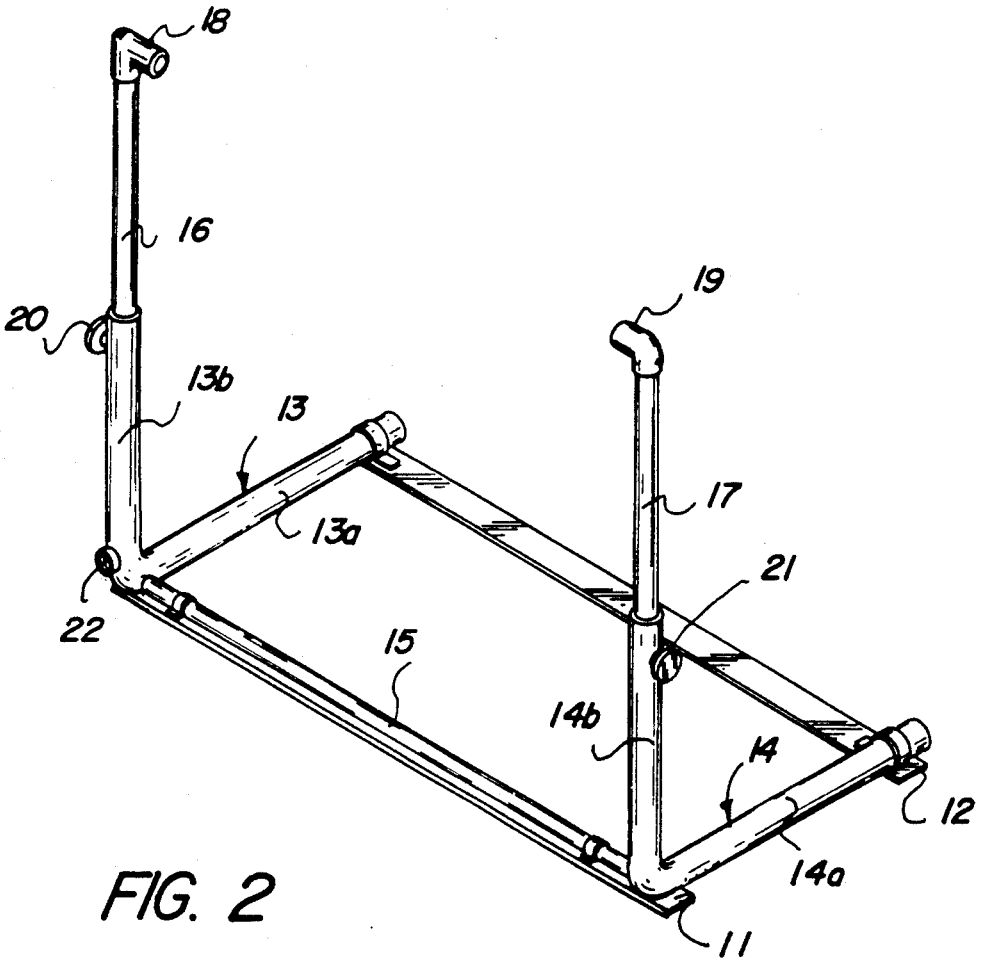
FIG. 1 is an isometric illustration of an individual water hurdle apparatus utilized by the invention.
Figure 2:
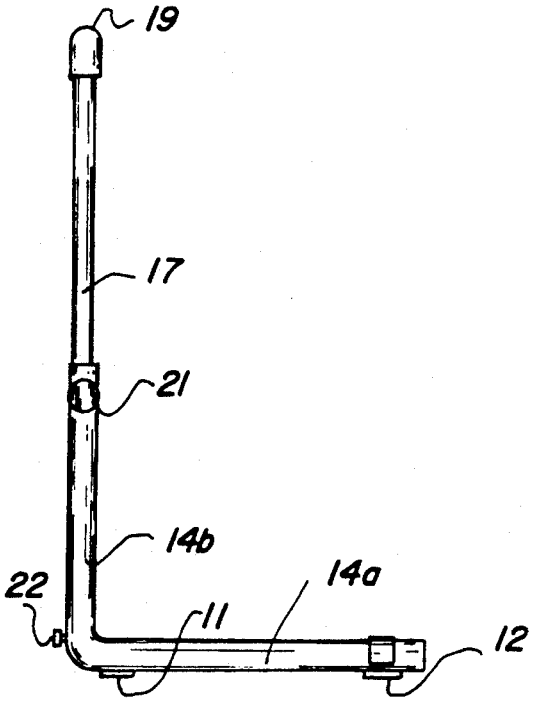
FIG. 2 is an orthographic side view of the invention as set forth in FIG. 1.

With reference now to the drawings, and in particular to FIGS. 1 to 17 thereof, a new and improved water hurdle apparatus embodying the principles and concepts of the present invention and generally designated by the reference numeral 10 will be described.

Figure 3:
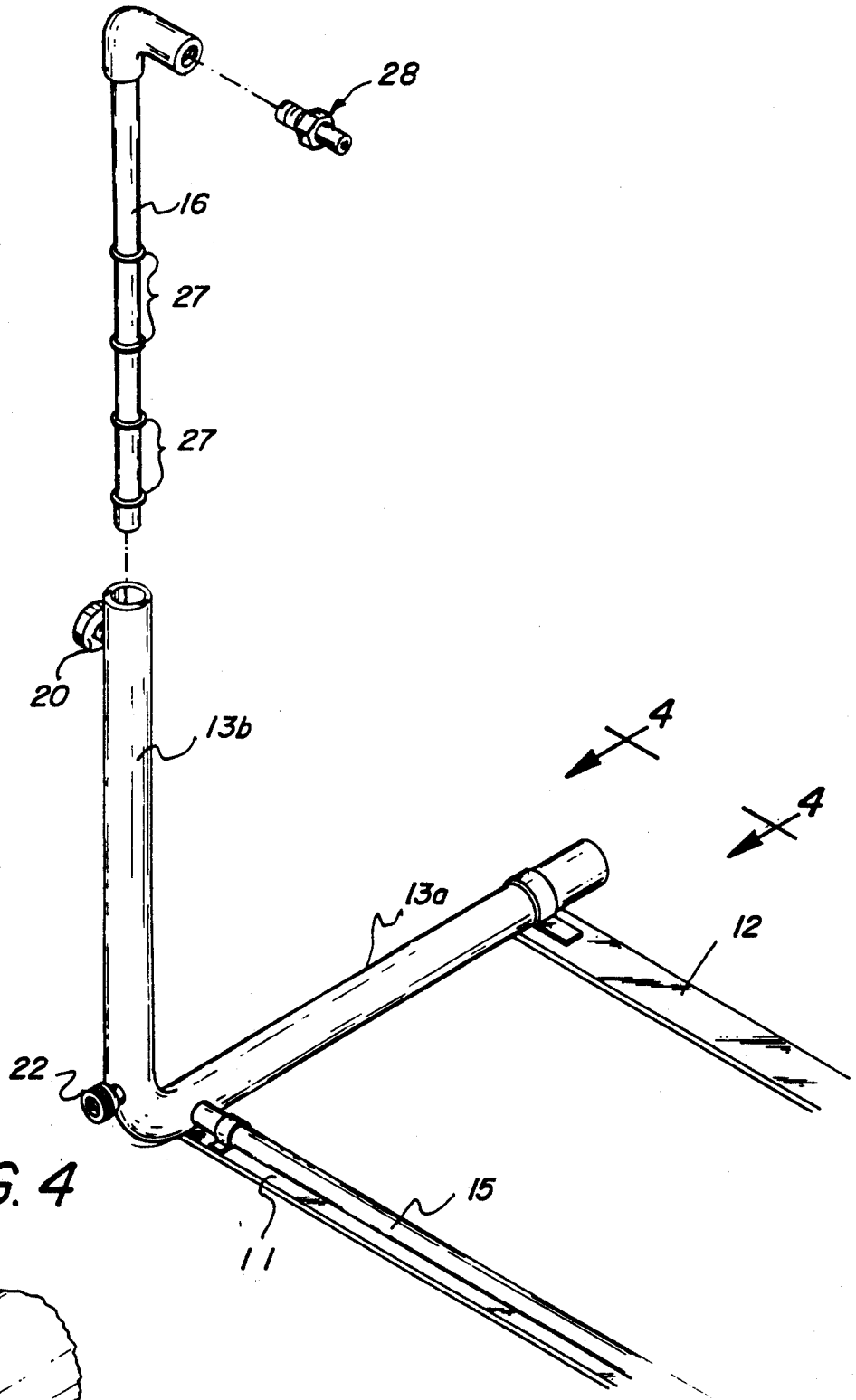
FIG. 3 is an isometric exploded partial view of the hurdle apparatus as set forth in FIG. 1.
Figure 4:
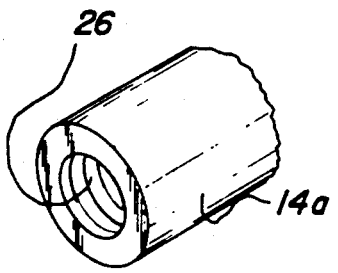
FIG. 4 is an orthographic view, taken along the lines 4—4 of FIG. 3 in the direction indicated by the arrows.
Figure 5:
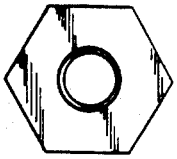
FIGS. 5, 8, 11, and 14 are orthographic rear views of various nozzles utilized by the instant invention.
Figure 6:
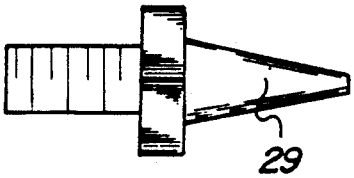
FIGS. 6, 9, 12, and 15 are orthographic side views of the respective nozzles of the FIGS. 5, 8, 11, and 14.
Figure 7:
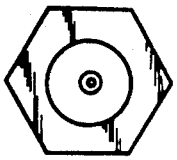
FIGS. 7, 10, 13, and 16 are orthographic front views of the respective nozzles of FIGS. 6, 9, 12, and 15.
Figure 8:
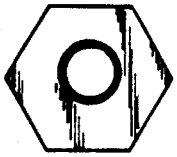
Figure 9:
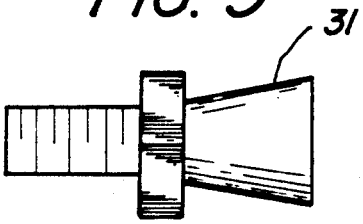
Figure 10:
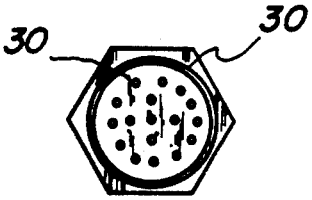
Figure 11:
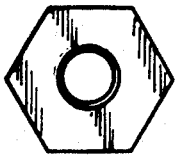
Figure 12:
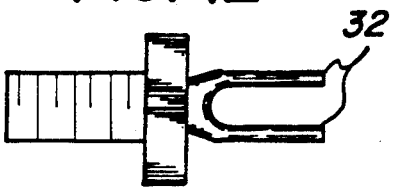
Figure 13:
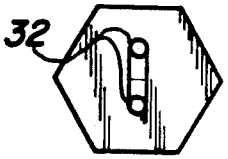
Figure 14:
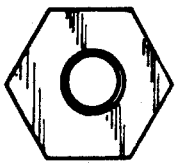
Figure 15:
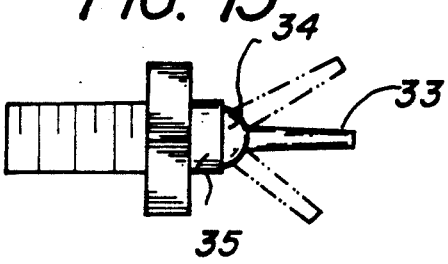
Figure 16:
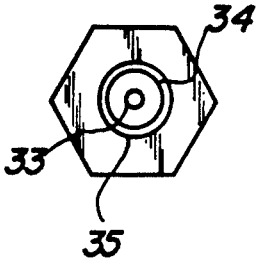
Figure 17:
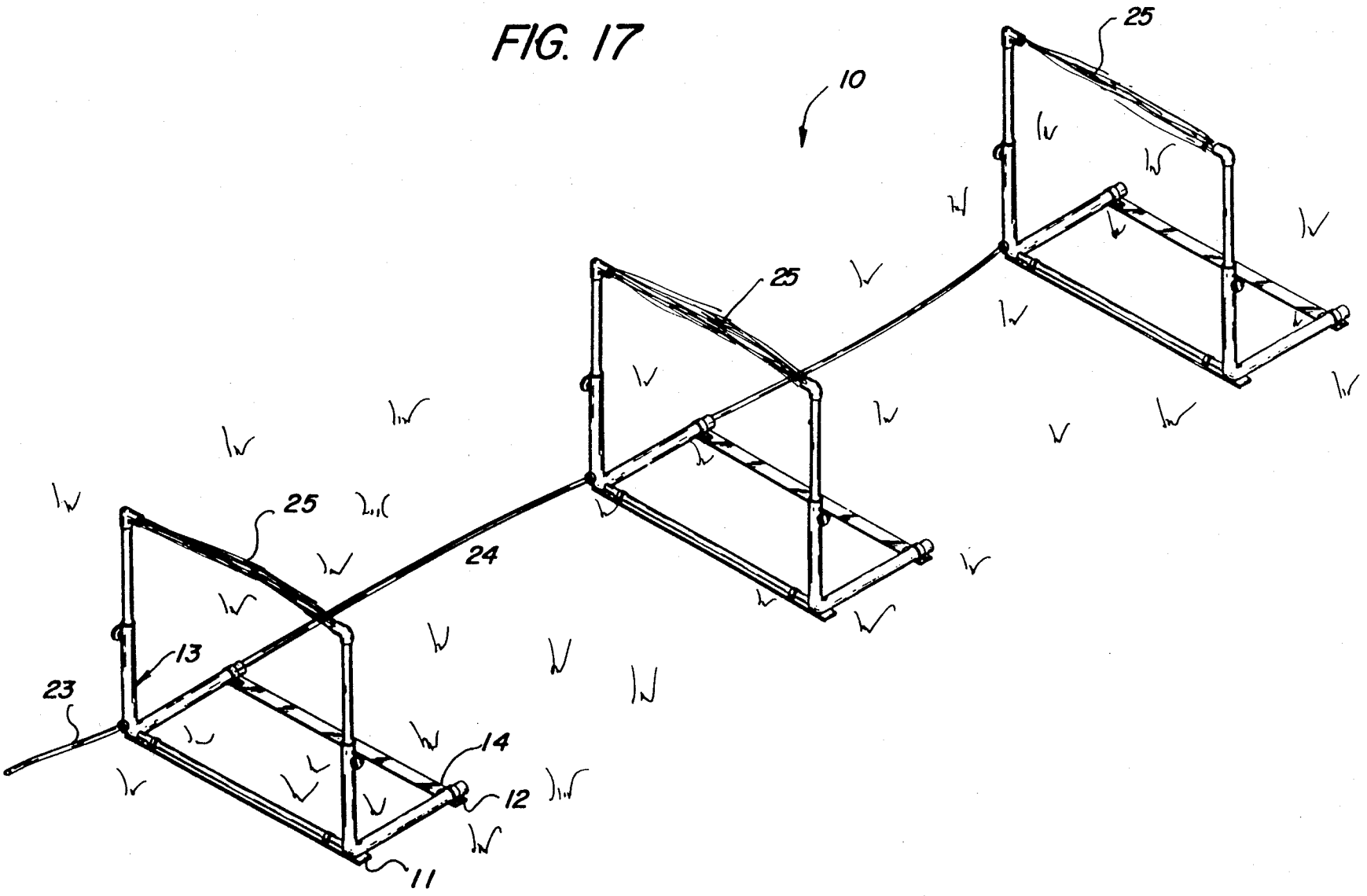
FIG. 17 is an isometric illustration of the instant invention in an assembled configuration.

More specifically, the water hurdle apparatus 10 of the instant invention essentially comprises a forward mounting plate 11 arranged parallel to, coplanar with, and coextensive with a rear mounting plate 12. An "L" shaped first conduit 13 is spaced from and parallel an "L" shaped second conduit 14 that are parallel relative to one another in a coextensive relationship and are orthogonally oriented to the forward and rear mounting plates 11 and 12 fixedly mounted thereto. The first conduit 13 includes a first tube 13*a* orthogonally mounted to the forward and rear plates 11 and 12 orthogonally oriented to a second tube 13*b*. The second conduit 14 includes a first conduit tube 14*a* orthogonally and fixedly mounted to the forward and rear mounting plates 11 and 12, wherein the second conduit first tube 14*a* is in fluid communication with a second conduit second tube 14*b*. A communicating conduit 15 effects fluid communication between the first and second conduits 13 and 14, as illustrated in FIG. 1. A first telescoping tube 16 and a second telescoping tube 17 are adjustably and telescopingly mounted within the respective first and second second tubes 13*b* and 14*b*. The first and second telescoping tubes 16 and 17 have in fluid communication at their upper distal ends respective first and second internally threaded directing conduits 18 and 19, wherein the directing conduits are arranged in coaxial alignment relative to one another, and wherein the first and second tubes 16 and 17 are adjustably mounted within the respective first and second conduit second tubes 13*b* and 14*b* by respective first and second lock fasteners 20 and 21 that are radially directed into the associated first and second conduit second tubes 13*b* and 14*b*. The first and second telescoping tubes 16 and 17 include a plurality of spaced parallel "O" rings 27 (see FIG. 3) to insure sealing of the telescoping tubes relative to the associated conduit tubes 13*b* and 14*b*. An inlet connector tube 22 including an internally threaded bore and an externally threaded periphery effects fluid communication with an associated delivery tube 23 to direct fluid interiorly of the hurdle member, as illustrated in FIG. 1. Reference to FIG. 4 illustrates that the first conduit first tube 13*a* terminates in an internally threaded first conduit outlet opening to receive either a plug or permit series alignment of a plurality of the hurdle members, in a manner as illustrated in'FIG. 17, utilizing a primary delivery tube 23 associated to a first hurdle member and to the inlet connector tube, with secondary delivery tubes 24 joining the hurdle members by connection to the internally threaded first conduit outlet opening 25 and an adjoining and adjacent inlet connector tube 22 of an adjacent hurdle member. A water stream hurdle 25 (see FIG. 17) is thereby effected with the coaxially aligned first and second directing conduits 18 and 19 in confronting relationship relative to one another providing a fluid hurdle. The FIGS. 5-16 illustrate a series of various nozzles that includes externally threaded shanks that are receivable within the internally threaded directing conduits 18 and 19. Such nozzles include a conical nozzle 29, as illustrated in FIG. 6, to provide for a finer stream of water; the conical surrounding tube 31 in surrounding relationship relative to an apertured plate 30 to provide for a fine stream directed towards one another as a water stream 25, a bifurcated nozzle 32, or a flexible nozzle 33 to permit distortion of the nozzle. The flexible nozzle 33 includes a ball member 34 receivable within a socket 35 permitting reorientation of the nozzle 33 to provide for arcuate adjustment of the nozzles and the resultant streams resulting therefrom. These nozzles 28, such as illustrated in FIG. 3, permit adjustment of the fluid flow between the confronting directing conduits 18 and 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. Water hurdle apparatus, comprising at least one hurdle member, including a forward mounting plate spaced from, parallel to, and in a coextensive coplanar relationship relative to a rear mounting plate, and an "L" shaped first conduit mounted to the forward mounting plate and the rear mounting plate at a first end of the forward mounting plate and the rear mounting plate, and an "L" shaped conduit mounted to a second distal end of the forward mounting plate and the rear mounting plate, wherein the first conduit and the second conduit are orthogonally oriented relative to the forward mounting plate and the rear mounting plate, and wherein the first conduit and the second conduit are in a parallel coextensive relationship relative to one another, and the first conduit including a first conduit first tube orthogonally mounted to the forward mounting plate and rear mounting plate and a first conduit second tube orthogonally oriented relative to the first conduit first tube in fluid communication therewith, and the "L" shaped second conduit including a second conduit first tube orthogonally mounted to the forward mounting plate and a second conduit second tube orthogonally oriented relative to the second conduit first tube in fluid communication therewith, and a first telescoping tube telescopingly and adjustably mounted within the first conduit first tube, and a second telescoping tube telescopingly and adjustably mounted within the second conduit second tube, the first telescoping tube including a first directing conduit orthogonally oriented relative to the first telescoping tube, and the second telescoping oriented relative to the second telescoping tube, and said first and second telescoping tube each including means to effect a fluid sealing relationship between the respective first telescoping tube and the second telescoping tube with the respective first conduit second tube and the second conduit second "tube".

and the first directing conduit and the second directing conduit are in a coaxially aligned spaced confronting relationship relative to one another.

and communicating fluid conduit in fluid communication between the "L" shaped first conduit and the "L" shaped second conduit to direct fluid flow therebetween, and the first conduit second tube including a first conduit outlet opening formed at a rear distal end of the first conduit second tube, and a fluid delivery tube arranged for securement to the first conduit outlet opening for securement to an adjacent hurdle member and the first conduit first tube including an inlet connector tube permitting securement of a primary fluid delivery tube to the inlet connector tube in a delivery of fluid into the hurdle member.

2. An apparatus as set forth in claim 1 including an adapter nozzle mounted within each of the first and second directing conduits.

3. An apparatus as set forth in claim 1 wherein the adapter nozzle includes a flexible nozzle mounted to a ball member, the ball member pivotally mounted within a socket to permit rotation of the flexible nozzle relative to the socket permitting orientation of fluid flow from the flexible nozzle.

4. An apparatus as set forth in claim 1 wherein the first conduit second tube and the second conduit second tube include a respective first lock fastener and a second lock fastener respectively for respective engagement with the first telescoping tube and the second telescoping tube.

5. An apparatus as set forth in claim 1 wherein the means to effect a fluid sealing between said telescopic members and said conduit tubes includes a plurality of spaced parallel "O" rings.

* * * * *